US005713782A

United States Patent [19]

Jensen et al.

[11] Patent Number: 5,713,782

[45] Date of Patent: Feb. 3, 1998

[54] BABY RATTLE AND A TOY COMPRISING A BABY RATTLE

[75] Inventors: Arne Egholm Jensen; Hanne Davidsen Jensen, both of Gentofte; Ib Hartmann Berggreen, Rungsted Kyst, all of Denmark

[73] Assignee: INTERLEGO AG, Baar, Switzerland

[21] Appl. No.: 714,855

[22] Filed: Sep. 17, 1996

[51] Int. Cl.[6] ..... A63H 5/00; A63H 33/00

[52] U.S. Cl. ..... 446/419; 446/490

[58] Field of Search ..... 446/419, 418, 446/421, 422, 128, 85, 490, 489

[56] References Cited

U.S. PATENT DOCUMENTS

| | | | |
|---|---|---|---|
| D. 159,667 | 8/1950 | Ross | 446/421 X |
| 1,299,430 | 4/1919 | Da Costa | 446/419 |
| 3,242,610 | 3/1966 | Christiansen | 446/128 |
| 3,439,572 | 4/1969 | Cohen | 446/422 X |
| 3,550,309 | 12/1970 | Vennola | 446/490 |
| 3,766,683 | 10/1973 | Vennola | 446/418 X |
| 4,919,635 | 4/1990 | Bertrand | 446/128 |
| 5,199,920 | 4/1993 | Christen | 446/419 |
| 5,484,320 | 1/1996 | Becker | 446/418 |

FOREIGN PATENT DOCUMENTS

| | | | |
|---|---|---|---|
| 1187380 | 9/1959 | France | 446/421 |
| 450019 | 9/1927 | Germany | 446/419 |
| 1408526 | 10/1975 | United Kingdom | 446/421 |

*Primary Examiner*—D. Neal Muir

*Attorney, Agent, or Firm*—Kane, Dalsimer, Sullivan, Kurucz, Levy, Eisele and Richard, LLP

[57] ABSTRACT

A baby rattle (1) comprising two rattle portions (2,3) and an elongated elastic spacer element (4) which connects the two rattle portions (2,3), wherein the two rattle portions (2,3) have mutually complementary coupling portions (5,6) which allow the two rattle portions (2,3) to be coupled to each other, and wherein the weight of the two rattle portions (2,3) and the rigidity of the elastic spacer element (4) are adjusted relative to each other so that the elastic spacer element (4), like a column, may in itself support the one rattle portion (2,3) when the elastic spacer element is maintained substantially vertically upright relative to the second rattle portion (3,2), and wherein the mutually complementary coupling portions (5,6) possess sufficient coupling force to keep the two rattle portions (2,3) together despite the force applied from the elongated elastic spacer element (4) by coupling of the rattle portions (2,3). Hereby a baby rattle is provided which makes many play options available by use of only a few constituents.

9 Claims, 2 Drawing Sheets

BABY RATTLE AND A TOY COMPRISING A BABY RATTLE

BACKGROUND OF THE INVENTION

1. Field of the Invention

The present invention relates to baby rattles and in particular a baby rattle consisting of two rattle portions and an elongated elastic spacer element that connects the two rattle portions.

2. Description of the Prior Art

Today baby rattles are available in a wide variety of embodiments with various integral functions, such as sounds of different characters, and rattles which may be manipulated in various ways.

Thus, examples of baby rattles of the type described above are known from i.a. U.S. Pat. No. 4,249,333 and FR design publication No. 384 039.

U.S. Pat. No. 4,249,333 thus teaches a baby rattle comprising a number of rings which are connected to each other to form a structure. Additionally, this structure is provided with two rattle portions which are secured to each other and to the structure by means of an elongated flexible connecting element.

The above-mentioned FR design publication No. 384 039 discloses a baby rattle comprising two rattle portions provided in the form of hollow balls which each contains a number of freely movable small elements to make a sound when the rattle portions are moved. The two ball-shaped rattle portions are connected to each other by means of a piece of string.

It is a recurring problem when designing baby rattles how to provide many different functions by use of comparatively few means. It is therefore the object of the present invention to provide a baby rattle of the type described in the introductory part which makes many different play options available by use of very few means.

SUMMARY OF THE INVENTION

This object is obtained by providing a baby rattle wherein the two rattle portions have mutually complementary coupling means which allow mutual coupling of the two rattle portions, and wherein the weight of the two rattle portions and the rigidity of the elastic spacer element are adjusted relative to each other so that the elastic spacer element, like a column, is in itself capable of supporting the one rattle portion when the elastic spacer element is maintained substantially vertically upright relative to the second rattle portion, and wherein the mutually complementary coupling elements establish an interference fit with sufficient resistance to keep the two rattle portions together despite the force applied by the elongated elastic spacer element to the two rattle portions when the rattle portions are coupled together.

As it is possible to couple and secure the two rattle portions to each other and owing to the presence of the elongated elastic spacer element, the baby rattle according to the present invention may in itself assume two different, stable positions. In the one position, the elongated elastic spacer element is substantially stretched to the position where it has no internal tensions, where the child may easily hold the one rattle portion and shake the other rattle portion which, due to the elastic spacer element, will move more or less freely. In the second stable position, the two rattle portions are coupled to each other whereby internal tension is produced in the elongated elastic spacer element whereby the spacer element becomes comparatively rigid and inflexible and thus forms a stiff handle, a teething ring or the like. Moreover, the two rattle portions may optionally be provided so that they form a figure when coupled together, and when uncoupled they form a completely different figure, the complementary coupling elements being completely or partially hidden when the rattle portions are coupled to each other.

According to a convenient embodiment, the baby rattle may be provided with means for the emission of sound in only one of the two rattle portions whereby the rattle is rendered capable of emitting at least three different sounds with the same sound-emitting means since the acoustic properties of the rattle portions change upon coupling and when they are seized.

The mutually complementary coupling elements may moreover consist of a coupling stud on the one rattle portion and a complementary constructed recess on the opposite rattle portion. Hereby the appearances of the respective rattle portions will differ substantially when uncoupled, but they may still form a more or less symmetrical figure, such as a ball, a sphere or the like when coupled, since those parts of the rattle portions which are visible after the coupling are substantially identical.

According to a preferred embodiment the elongated elastic spacer element is substantially in the form of an elongated, essentially rod-shaped element with a longitudinal axis which extends between the two rattle portions, and the complementary coupling elements on the two rattle portions are so designed that their coupling orientations relative to each other are transversal to the longitudinal axis of the elongated, elastic spacer element. This makes the procedure of coupling the two rattle portions to each other very simple, since the two rattle portions are in a simple manner pressed towards each other which makes the elongated elastic spacer element flex and thereby convey the coupling elements towards each other.

The coupling may further be facilitated by connecting the two rattle portions in a torsionally rigid manner to the elongated spacer element whereby the coupling elements are caused to be arranged on the same side relative to the elongated elastic spacer element.

The length of the elongated elastic spacer element may advantageously be adapted to ensure that at least the major part of the elongated elastic spacer element follows an circular arc or a parabola upon coupling of the two rattle portions.

By manufacturing the elongated elastic spacer element from an elastic rubber material and by optionally providing the spacer elements with profiles, protruding studs or the like, a spacer element is obtained which is particularly suitable as a teething ring for a baby.

Moreover, each of the two rattle portions may be substantially in the form of semispheres with a plane side opposite the semispherical side, and wherein the complementary coupling elements are arranged on the plane sides of the rattle portions, and the elongated elastic spacer element is secured to the two rattle portions on the semispherical side. This makes it particularly simple for a baby to perform the coupling operation for the two rattle portions, simply by pressing the rattle portions towards each other following which the rattle portions will automatically be conveyed towards each other.

The invention further relates to a toy comprising a baby rattle, wherein this toy further comprises a number of building or stacking blocks which are each provided with a number of coupling elements corresponding to the coupling elements on the rattle portions of the baby rattle whereby the baby rattle may be used as a building component by coupling of the baby rattle onto a building/stacking block. This enables use of the baby rattle as a part of a toy system whereby the baby rattle may becomes a suitable toy for older children, which provides the above-mentioned advantages relating to the number of play options made available by the invention.

BRIEF DESCRIPTION OF THE DRAWINGS

Various embodiments of the invention will be described in further detail in the following with reference to the drawings, wherein.

DESCRIPTION OF PREFERRED EMBODIMENTS

Figure 1:
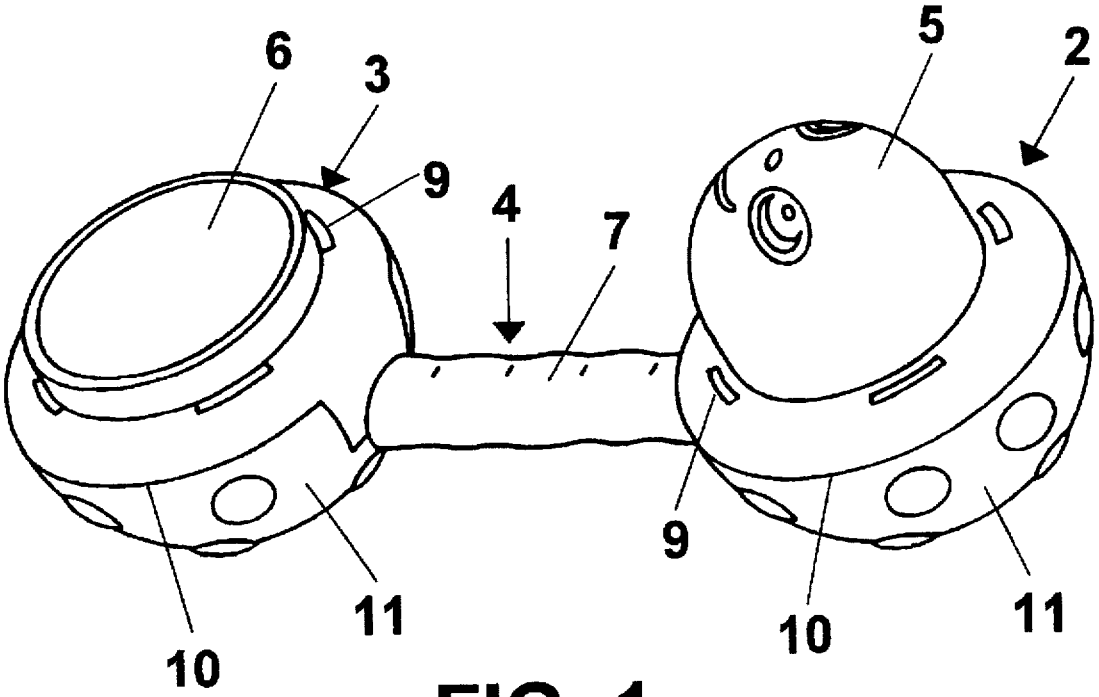
FIG. 1 is a perspective view of a preferred embodiment of a baby rattle according to the present invention in a first stable position.

Thus, FIG. 1 illustrates a preferred embodiment of a baby rattle 1 according to the present invention wherein the baby rattle is illustrated with two rattle portions 2,3 which are each made of a die-cast plastics material, and each consisting of at least two constituents which have been assembled at the dividing lines 9,10 to form the individual rattle portion 2,3.

In the shown embodiment these constituents consist of a first coupling element in the form of a coupling stud 5, a second coupling element having a recess 6 of a design which is complementary relative to the coupling element for frictional coupling with the coupling stud 5, and two substantially identical spherical parts 11, respectively. In this way the two rattle portions 2,3 consist of a total of only three different constituents 5,6,11 whereby tooling economies are obtained.

According to the invention, an elongated elastic spacer element 4 of a certain rigidity is provided between the two rattle portions 2,3. The spacer element 4 is secured in a torsionally rigid manner to the two rattle portions 2,3 and is conveniently made of an elastic rubber material.

In this manner the two rattle portions 2,3 in combination with the spacer element 4 constitute a rattle 1 where a baby may according to choice seize the one rattle portion and shake the rattle 1 whereby the second rattle portion will swing about in accordance with the flexibility of the spacer element 4 and the weight of the second rattle portion.

According to the invention, the bending elasticity of the elastic spacer element 4 is selected to enable the elastic spacer element 4 to support the weight of a rattle portion 2,3, substantially like a column, without collapsing. It would be particularly preferable if the bending elasticity was substantially lower, optionally such that the elastic spacer element 4 may support the weight of a rattle portion like a cantilever beam without collapsing. However, with reference to the following description of FIG. 2, it will become obvious that there is a lower limit for the bending elasticity of the spacer element 4 since it is of particular importance that it is relatively easy for a baby to flex this spacer element 4.

Thus, the lower limit for the bending elasticity of the elastic spacer element 4 is defined to be such that the baby should be capable of flexing this spacer element 4 without substantial effort. Thus, the invention provides a baby rattle which may, in addition to the stable position shown in FIG. 1 where the elastic spacer element is substantially upright, further be caused to assume the stable position shown in FIG. 2 where the two rattle portions 2,3 are coupled to each other and the elastic spacer element 4 is bent.

According to the invention, this is obtained by the coupling force between the coupling portions 5,6 on the two rattle portions 2,3 being so high that it may keep the rattle portions 2,3 coupled together despite the force which influences the rattle portions via the bent spacer element 4 due to the bending elasticity of that spacer element 4.

Figure 2:
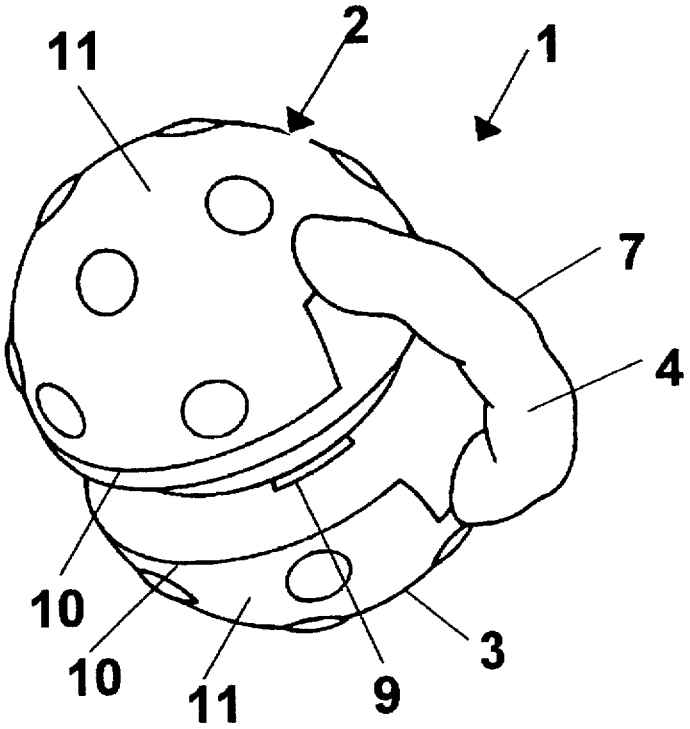
FIG. 2 is a perspective view of the baby rattle shown in FIG. 1 in a second stable position.

Owing to the internal tensions in the elastic spacer element 4 and the bent configuration it assumes in this position, the spacer portion 4 in the stable position shown in FIG. 2 constitutes a suitable teething ring for a baby, and the two rattle portions form a suitable seizing handle for the baby.

The length of the elastic spacer element 4 may vary within wide ranges, however with a lower limit defined by the obvious need to couple the two rattle portions 2,3 together without having to pull the spacer element 4 significantly.

In accordance with FIG. 2, by imparting to the spacer element 4 a length which allows the spacer element 4 to assume the form of a substantially circular arc or a parabola upon coupling of the two rattle portions, and imparting to the rattle portions the semispherical shape shown, it is ensured that it is particularly easy to couple the two rattle portions 2,3 together, simply by pressing the two rattle portions towards each other.

It is obvious that the two rattle portions in the baby rattle according to the invention may be provided with means for the emission of sound when the baby rattle is shaken or moved in any other way. However, in a preferred embodiment such means are only provided in one of the rattle portions 2,3 whereby the rattle provides the option of emitting three different sounds depending on the relevant rattle portion 2,3 seized or whether the rattle portions 2,3 are coupled when the baby rattle is moved or shaken.

Figure 3:
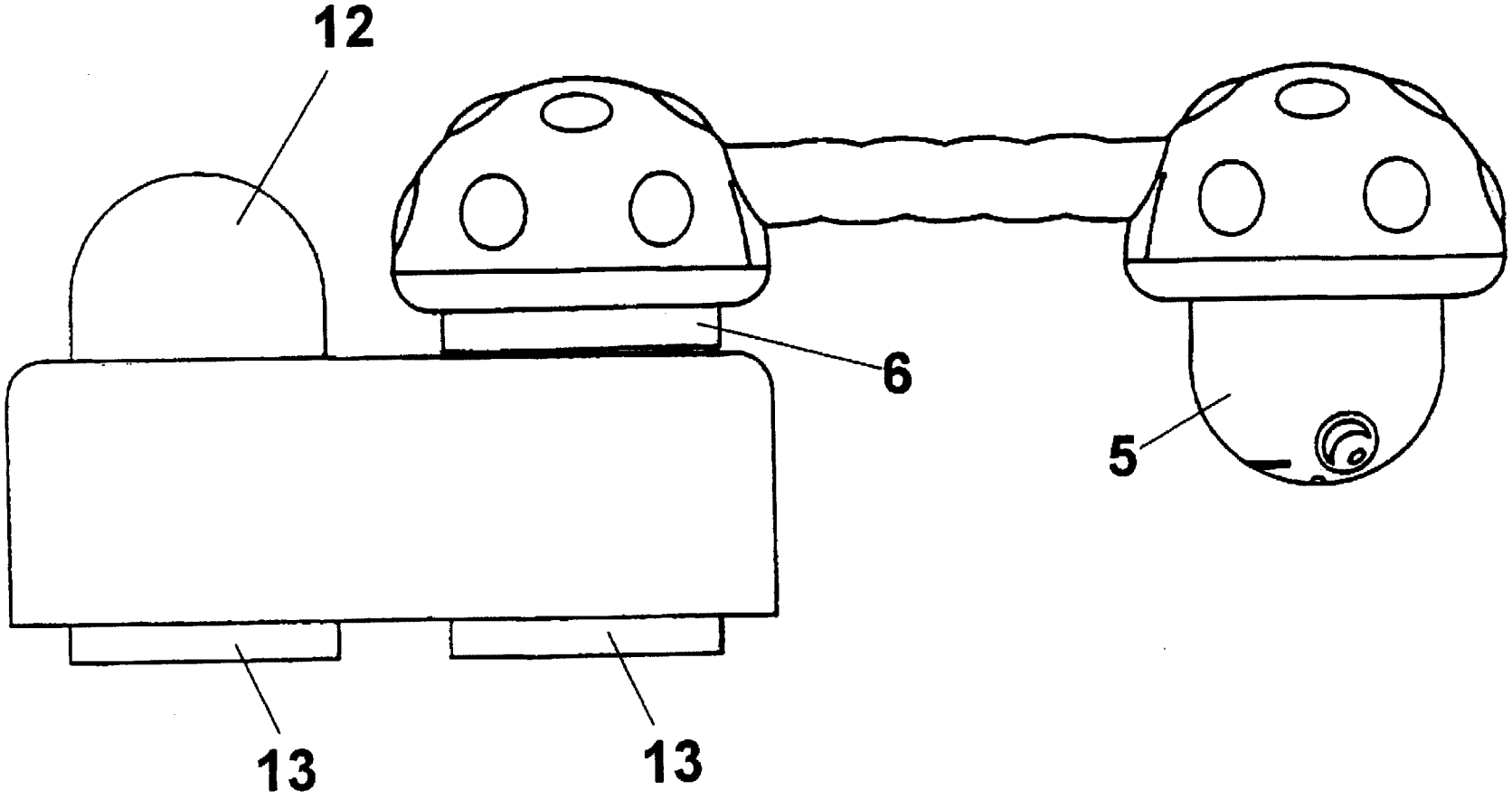
FIG. 3 is a side view showing the baby rattle according to FIGS. 1 and 2 mounted on a building or stacking block.

Now, FIG. 3 illustrates an alternative aspect of the present invention, wherein the very presence of the coupling elements on the rattle portions allows the baby rattle to be used as a building component in a building or stacking block system. According to the invention, a baby rattle is hereby provided which may be used by children older than "rattle-age children". The advantages of the rattle with a view to e.g. the emission of sounds, etc., as described above will thus be applicable in connection with a building system.

This is obtained by providing the coupling elements on the baby rattle 1 in a form similar to that of the corresponding coupling elements 12,13 which are present on the building or stacking blocks 8 in the building or stacking block system.

It is obvious that various embodiments of the present invention may be exercised in other ways than illustrated in the Figures. Thus, the baby rattle may comprise more than two rattle portions and optionally more elongated elastic spacer elements, and rattle portions as well as spacer elements may also have different shapes without deviating from the basic idea of the invention. Moreover, the coupling elements may be provided in a number of alternative ways, other than the embodiment shown. Even though the baby rattle is most conveniently made of a plastics material, e.g. by die-casting, it is obvious that other materials, such as wood, may also be used.

We claim:

1. A baby rattle (1) comprising two rattle portions (2,3) and an elongated elastic spacer element (4) which connects the two rattle portions (2,3), CHARACTERIZED IN that the two rattle portions (2,3) have mutually complementary coupling elements (5,6) which allow the two rattle portions (2,3) to be coupled to each other, and wherein the weight of the two rattle portions (2,3) and the rigidity of the elastic spacer element (4) are adjusted relative to each other so that the elastic spacer element (4), like a column, is in itself capable of supporting the one rattle portion (2,3) when the elastic spacer element (4) is maintained substantially vertically upright relative to the second rattle portion (3,2), and wherein the mutually complementary coupling elements (5,6) establish an interference fit with sufficient resistance to keep the two rattle portions (2,3) together despite the force applied by the elongated elastic spacer element (4) to the two rattle portions (2,3) when the rattle portions (2,3) are coupled to each other.

2. A baby rattle according to claim 1, CHARACTERIZED IN that the mutually complementary coupling elements (5,6) are constituted of a coupling stud (5) on the one rattle portion (2), and a complementarily designed recess (6) on the second rattle portion (3).

3. A baby rattle according to claim 1, CHARACTERIZED IN that the elongated elastic spacer element (4) is substantially in the form of an elongated, essentially rod-shaped element with a longitudinal axis extending between the two rattle portions (2,3), and that the complementary coupling elements (5,6) on the two rattle portions (2,3) are so arranged that their coupling orientation relative to each other is transversal to the longitudinal axis of the elastic spacer element.

4. A baby rattle according to claim 3, CHARACTERIZED IN that the two rattle portions (2,3) are connected in a torsionally rigid manner to the elongated elastic spacer element (4), and that the coupling elements (5,6) on the two rattle portions (2,3) are arranged on the same side relative to the elongated elastic spacer element (4).

5. A baby rattle according to claim 3, CHARACTERIZED IN that the length of the elongated elastice spacer element (4) is adapted so that upon coupling of the two rattle portions (2,3), its longitudinal axis substantially follows a circle for the major part of the length of the elongated elastic spacer element (4).

6. A baby rattle according to claim 1, CHARACTERIZED IN that the elongated elastic spacer element (4) is constituted completely of an elastic material.

7. A baby rattle according to claim 6, CHARACTERIZED IN that the surface of the elongated elastic spacer element (4) is provided with profiles or protruding studs (7).

8. A baby rattle according to claim 5, CHARACTERIZED IN that the two rattle portions (2,3) are each substantially semispherical and provided with a plane surface opposite the semispherical side, and wherein the complementary coupling elements (5,6) are arranged on the plane sides of the rattle portions (2,3), and the elongated elastic spacer element (4) is secured to the two rattle portions (2,3) on the semispherical side.

9. A toy comprising a baby rattle (1) having two rattle portions (2,3 and an elongated elastic spacer element (4) which connects the two rattle portions (2,3), CHARACTERIZED IN that the two rattle portions (2,3) have mutually complementary coupling elements (5,6) which allow the two rattle portions (2,3) to be coupled to each other and wherein the weight of the two rattle portions (2,3) and the rigidity of the elastic spacer element (4) are adjusted relative to each other so that the elastic spacer element (4), like a column, is in itself capable of supporting the one rattle portion (2,3) when the elastic spacer element (4) is maintained substantially vertically upright relative to the second rattle portion (3,2), and wherein the mutually complementary coupling elements (5,6) establish an interference fit with sufficient resistance to keep the two rattle portions (2,3) together despite the force applied by the elongated elastic spacer element (4) to the two rattle portions (2,3) when the rattle portions (2,3) are coupled to each other; and a number of building or stacking blocks (8) which are each provided with a number of coupling elements (12) corresponding to the coupling elements (5,6) on the rattle portions (2,3) of the baby rattle (1), thereby allowing the baby rattle (1) to be used as a building component by the coupling of the baby rattle (1) onto a building or stacking block (8).

* * * * *